US011400610B2

(12) United States Patent
Moustakas

(10) Patent No.: US 11,400,610 B2
(45) Date of Patent: Aug. 2, 2022

(54) SKIN ADAPTER

(71) Applicant: Bic Violex S.A., Anoixi (GR)

(72) Inventor: Panagiotis Moustakas, Anoixi (GR)

(73) Assignee: Bic Violex Single Member S.A., Anoixi (GR)

( * ) Notice: Subject to any disclaimer, the term of this patent is extended or adjusted under 35 U.S.C. 154(b) by 45 days.

(21) Appl. No.: 16/834,553

(22) Filed: Mar. 30, 2020

(65) Prior Publication Data

US 2020/0338770 A1 Oct. 29, 2020

(30) Foreign Application Priority Data

Apr. 23, 2019 (EP) ..... 19170649

(51) Int. Cl.
*B26B 21/40* (2006.01)
*B26B 21/44* (2006.01)

(52) U.S. Cl.
CPC ..... *B26B 21/4018* (2013.01); *B26B 21/4031* (2013.01); *B26B 21/443* (2013.01)

(58) Field of Classification Search
CPC ..... B26B 21/4018; B26B 21/4031; B26B 21/4037; B26B 21/42
USPC ..... 30/30, 31, 47–51, 537, 539, 233.5; D28/46, 49, 53
See application file for complete search history.

(56) References Cited

U.S. PATENT DOCUMENTS 4,346,721 A * 8/1982 Molaro ..... B26B 21/12 132/313
4,663,841 A * 5/1987 Custer ..... B26B 21/42 30/63
4,709,476 A * 12/1987 Shurtleff ..... B26B 21/4037 30/41
4,914,817 A * 4/1990 Galligan ..... B26B 21/4006 30/77
D312,144 S * 11/1990 Buba ..... D28/52
5,579,580 A * 12/1996 Althaus ..... B26B 21/4006 30/50
5,893,213 A * 4/1999 Motta ..... B26B 21/4037 30/540
D616,147 S * 5/2010 Adams ..... D28/46
D616,606 S * 5/2010 Adams ..... D28/54
(Continued)

FOREIGN PATENT DOCUMENTS

DE 202005013297 U1 12/2005
FR 2599657 A1 12/1987

OTHER PUBLICATIONS

European Search Report in EP 19170649.8, dated Oct. 1, 2019 (8 pages).

*Primary Examiner* — Jason Daniel Prone
(74) *Attorney, Agent, or Firm* — Bookoff McAndrews, PLLC.

(57) ABSTRACT

A skin adapter designed to attach to a head unit of a razor, the skin adapter including an outer member, the outer member having a leading portion with a leading side, a trailing portion with a trailing side, and an aperture arranged between the leading portion and the trailing portion, the leading portion and trailing portion being positioned on an outermost surface of the outer member, the aperture being inaccessible from the leading and trailing side, and one or more ribbons positioned within the aperture of the outer member, the ribbons extending between the leading portion and trailing portion of the outer member.

20 Claims, 4 Drawing Sheets

(56) References Cited

U.S. PATENT DOCUMENTS

| | | | | |
|---|---|---|---|---|
| D617,497 | S * | 6/2010 | Goodhead | D28/54 |
| D630,377 | S * | 1/2011 | Wattam | D28/46 |
| 7,954,244 | B2 * | 6/2011 | Orloff | B26B 21/42 30/50 |
| 8,015,710 | B1 | 9/2011 | Zyla | |
| 9,751,226 | B2 * | 9/2017 | Psimadas | B26B 21/4037 |
| 9,919,441 | B2 * | 3/2018 | Drori | B26B 21/4018 |
| 10,144,142 | B1 * | 12/2018 | Squires | B26B 21/4006 |
| 10,780,596 | B2 * | 9/2020 | Squires | B26B 21/4037 |
| 10,786,914 | B2 * | 9/2020 | Galanis | B26B 21/4037 |
| 10,836,060 | B2 * | 11/2020 | Squires | B26B 21/42 |
| 11,045,965 | B2 * | 6/2021 | Galanis | B26B 21/4006 |
| D926,374 | S * | 7/2021 | Washington | D28/47 |
| 11,173,621 | B2 * | 11/2021 | Squires | B26B 21/42 |
| 2002/0083600 | A1 * | 7/2002 | Donovan | B26B 21/4037 30/526 |
| 2003/0070304 | A1 | 4/2003 | Curello | |
| 2009/0007442 | A1 * | 1/2009 | Kurihara | B26B 21/4006 30/526 |
| 2010/0011586 | A1 * | 1/2010 | Nicoll | B26B 21/42 30/34.1 |
| 2011/0214290 | A1 * | 9/2011 | Micinilio | B26B 21/42 30/32 |
| 2017/0210020 | A1 * | 7/2017 | Bozikis | B26B 21/4037 |
| 2018/0169879 | A1 * | 6/2018 | Psimadas | B26B 21/42 |
| 2018/0333879 | A1 | 11/2018 | Squires et al. | |
| 2019/0299460 | A1 * | 10/2019 | Lechuga | B26B 21/42 |
| 2021/0129364 | A1 * | 5/2021 | Langberg | B26B 21/4018 |
| 2022/0072725 | A1 * | 3/2022 | Drori | B26B 21/4018 |

* cited by examiner

SKIN ADAPTER

This application claims benefit from European patent application EP 19170649.8, filed on Apr. 23, 2019, the entirety of which is incorporated herein by reference.

BACKGROUND

1. Field

The following description relates to a skin adapter for shaving devices, and more particularly to a skin adapter having an outer member comprising a ribbon configured to engage hair during a shaving operation.

2. Description of Related Art

Conventional shaving devices generally include a head unit having at least one or more cutting members or blades retained therein. The at least one or more cutting members or blades have cutting edges that are aligned in the same plane or substantially in the same plane with the exterior of the head unit.

A common drawback of conventional shaving heads with cutting members (either fixed blades or movable blades), is the aggressive shaving resulting in nicks and cuts, due to the high exposure of the blades. Even if a lubricating element is placed on the shaving head, the glideness of the shaving head is limited due to the high exposure of the blades.

SUMMARY

The present disclosure provides a skin adapter configured to attach to a head unit of a razor. The skin adapter comprising an outer member configured to attach to the head unit. The outer member having a leading portion, trailing portion, and an aperture arranged between the leading portion and the trailing portion. The leading portion and trailing portion being positioned on an outermost surface of the outer member, and one or more ribbons positioned within the aperture of the outer member. The ribbons extending between the leading portion and trailing portion of the outer member.

According to the current disclosure a skin adapter configured to attach to a shaving head, effectively results in the cutting edge exposure being negative relative to the skin adapter surface. Furthermore, the ribbons effectively cause the hair to be aligned with the ribbons or "prepared" before being cut by the cutting members. This configuration reduces the occurrence of nicks and cuts by providing additional contact points which increases the surface area that the shaving force is applied over the skin during shaving and aligns the hair in a manner that reduces the number of times and orientations the cutting members need to go over the skin in order for a user to have a satisfactory shave.

The ribbons may have a width within a range of 0.3 mm to 3.5 mm.

The skin adapter may comprise two or more ribbons arranged with a distance in between. The distance between ribbons is within a range of 2 mm to 20 mm.

The ribbons may be monolithically formed with the outer member.

The ribbons may be formed of a polymer.

The ribbons may be formed of a metal.

The outer member may comprise at least one lubricating element positioned on at least a portion of the outermost surface of the outer member.

The outer member may comprise at least one lubricating element positioned on at least one of the leading portion and trailing portion.

In examples, a razor comprises a handle, a head unit comprising at least one shaving blade with a cutting edge, the head unit being configured to connect with the handle; and the aforementioned shield adapter.

The skin adapter may comprise a plurality of protrusions or recesses that may be configured to engage corresponding protrusions or recesses provided on the head unit.

The outer member of the skin adapter may be configured to be slidably engaged the head unit.

The skin adapter may be configured to expose at least a portion of the at least one razor blade.

A shaving plane may be defined by a tangential line intersecting the leading portion and the trailing portion of the adapter. A cutting edge exposure may be defined as the vertical distance between the cutting edge and the shaving plane.

In examples, a method of making a skin adapter comprises: providing a foil having a plurality of ribbons; and insert molding an outer member with the foil.

DETAILED DESCRIPTION

Figure 1:
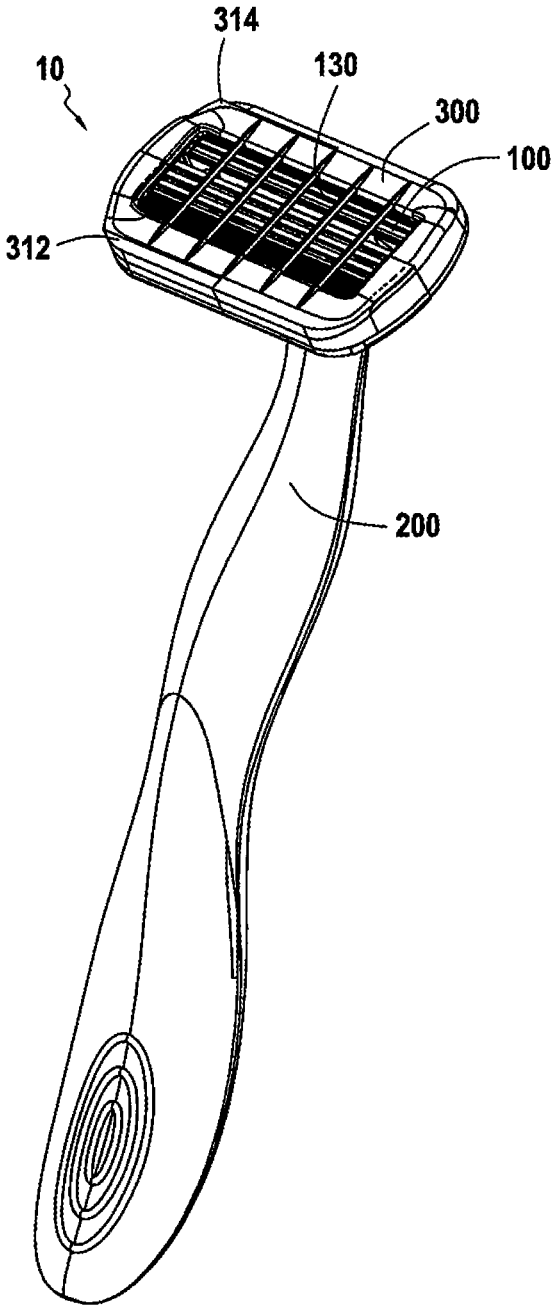
FIG. 1 details a razor having a skin adapter thereon.

FIG. 1 shows a razor 10 having a skin adapter 300 thereon. A razor 10 includes a head unit 100 including a plurality of blades 130. The head unit 100 is configured to be connected to a handle 200. The handle 200 may be elongate in shape, however it also envisioned that the handle may be any other appropriate shape, for example, disk shaped.

Figure 2A:
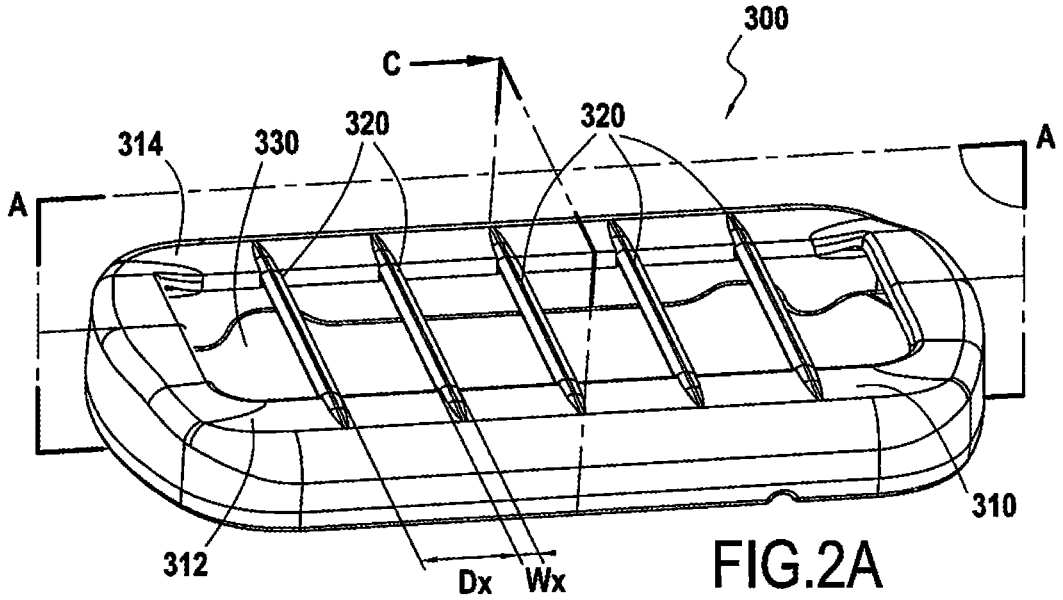
FIG. 2A details a perspective view of a skin adapter.

FIG. 2A details a perspective view of the skin adapter 300 of FIG. 1. The skin adapter 300 may comprise an outer member 310. The outer member 310 may have a leading portion 312 and a trailing portion 314. The leading and trailing portions 312, 314 depend on how the skin adapter 300 is attached to the head unit 100. In other words, the leading portion 312 is the portion that contacts skin first and the trailing portion 314 contacts the skin after the leading portion 312 during a shaving operation.

The skin adapter 300 may further include an aperture 330 centered in the outer member 310 of the skin adapter 300. As seen in FIG. 1, the aperture 330 is configured to allow a user to access the blades 130 in the head unit 100 when the skin adapter 300 is attached to the head unit 100.

Returning to FIG. 2A, the skin adapter 300 may comprise a plurality of ribbons 320. The plurality of ribbons 320 may extend between the leading and trailing portions 312, 314 of the outer member 310. The plurality of ribbons 320 may have a pitch or distance Dx therebetween. The distance Dx may be within a range of 2 to 20 mm, optionally 5 to 15 mm. Each of the ribbons 320 may have a width Wx within a range of 0.3 mm to 3.5 mm, optionally 1.0 mm to 1.5 mm. The pitch may vary and may be optimized for different skin and hair types. For example, a smaller pitch pattern of ribbons 320 may be suitable for sensitive skin and a larger pitch pattern may be suitable for dense hair. For sensitive skin the Dx may optionally be <8 mm for more dense hair Dx may be >6 mm. In this example five ribbons are depicted, however in alternatives any other number of ribbons may be foreseen including a single ribbon. In examples, the single ribbon may be centered within the aperture 330.

Figure 2B:
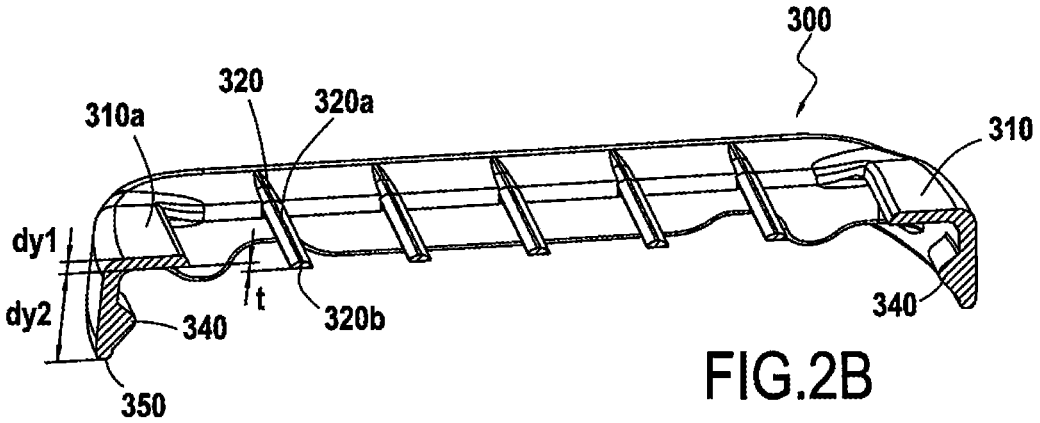
FIG. 2B details a perspective view of a cross-section of the skin adapter of FIG. 2A along plane A-A.

Shown in FIG. 2B is a cross-section of the shaving adapter 300 in FIG. 2A along plane A-A. The outermost surface 320*a*, or the surface facing away from the blades 130, of the ribbons 320 may be at a distance dy1 from the outermost surface 310*a* of the outer member 310. dy1 may be defined as the vertical distance between the outermost surface 310*a* of the outer member and the outermost surface of the ribbon 320*a*. This distance may be a in a range of 1 mm<dy1<3 mm for shaving and −10 mm<dy1<1 mm for trimming.

The ribbons 230 may have a thickness t within a range of 0.4 mm<t<1.0 mm for shaving and trimming: 1.0<t<10.0 mm for trimming. This thickness prevents the ribbons from deflecting toward the blades 130 of the head unit 100 when a user applies a pressure on the ribbons 230 during a shaving operation. The thickness t of the ribbons 320 may also vary and may be optimized for different hair length needs. For example, a small thickness t for close shave or high thickness for sensitive skins or for trimming.

Additionally, the innermost surface 320*b* of the ribbons 230 may be at a distance dy2 from a bottom surface 350 of the outer member 310. dy2 may be defined as the distance between the innermost surface of the ribbon 320*b* from the bottom surface 350 of the outer member. This distance may be a in a range of 3 mm<dy2<5 mm for shaving and 5 mm<dy2<15 mm for trimming.

The outer member 310 further comprises an attachment portion 340 configured to releasably attach the skin adapter 300 onto the head unit 100. In the example shown in FIG. 2B and FIG. 2C, the attachment portion 340 is formed as a protuberance. It is envisioned that the attachment portion 340 may attach into a corresponding attachment portion on the head unit 100 (not shown) which may be formed as a corresponding recess. However, it is also envisioned that the head unit 100 may have the protuberance and the attachment portion 230 on the skin adapter 300 may be a corresponding recess. This may be a snap-fit.

Alternatively, the attachment portion 230 may be configured to be slidable mounted on the head unit 100. In these examples, the attachment portion 230 may be shaped as a peripheral skirt defining longitudinal guides and having at least one open side.

The ribbons 320 are positioned within the aperture 330 of the outer member 310 but are dimensioned in a manner to allow a user to access the blades 130 of the head unit when the skin adapter 300 is attached to the head unit 100. Further, the positioning of the ribbons relative to the cutting edges 130*a* of the blades 130 may vary depending on the operation that the user wishes to follow, for example shaving or trimming.

In this configuration, the skin adapter 300 acts as a guard between a user's skin and the blades 130 during a shaving operation. Furthermore, an aspect of this configuration is to position the blades 130 in an exposure that is negative relative to the shaving plane which is defined by a tangential line intersecting the leading portion 312 and the trailing portion 314. If the cutting edge 130 is aligned with (or positioned at) the shaving plane the cutting edge exposure is considered neutral, if the cutting edge 130 is above the shaving plane (for example, FIG. 3A) the cutting edge exposure is considered positive, and if the cutting edge 130 is below the shaving plane, the cutting edge exposure is considered negative. A cutting edge exposure is defined as the vertical distance between the cutting edge 130*a* and the shaving plane. Incorporating a negative blade exposure on a head unit 100 reduces the occurrence of nicks and cuts. Furthermore, the ribbons 320 act as additional contact points with the skin thus reducing the skin bulging effect and reduces irritation. In other aspects, the blades may be positioned with an exposure that is positive or neutral, relative to the above described shaving plane. With this configuration, a positive cutting edge exposure may be more suitable for users who desire a closer shave with fewer strokes needed. Razor cartridges combining negative and positive cutting edge exposures may also be foreseen. In detail, a distance "S" is defined as the vertical distant between the outermost surface 320*a* of a ribbon 320 and the cutting edge plane. The distance S may be in a range of 0 mm<S<1 mm for shaving and 1 mm<S<10 mm for trimming. This is shown in FIG. 2C.

These configurations may be beneficial for a user who has sensitive skin. Furthermore, the ribbons 320 may be adapted to comb or position the hair during a shaving operation. These configurations urge the hair into a more optimal position so that more hair may be cut during a single pass compared to a razor not incorporating the ribbons 320. This is especially helpful for users whose hair grows in different directions, thus reducing the need to shave over a single spot multiple times and/or in different orientations, which can cause further irritation to the skin.

The skin adapter 300 may include any appropriate number of ribbons 320 that would guard a user's skin from excessive contact with blades 130 while also permitting a user to access the blades 130 during a shaving operation, for example, 2 to 8 ribbons 320.

Figure 2C:
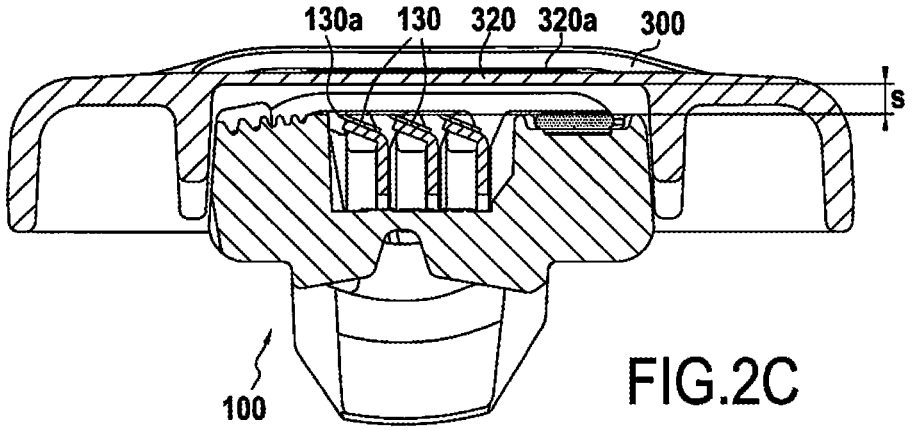
FIG. 2C details a perspective view of a cross-section of the skin adapter and razor along plane A-A.

In the Examples shown in FIGS. 2A-2C, the skin adapter 300 may be formed monolithically. Additionally, the skin adapter may comprise any appropriate material, for example, metal, elastomer, or polymer. The skin adapter may be made by any appropriate method, for example, injection molding or over molding.

Figure 3A:
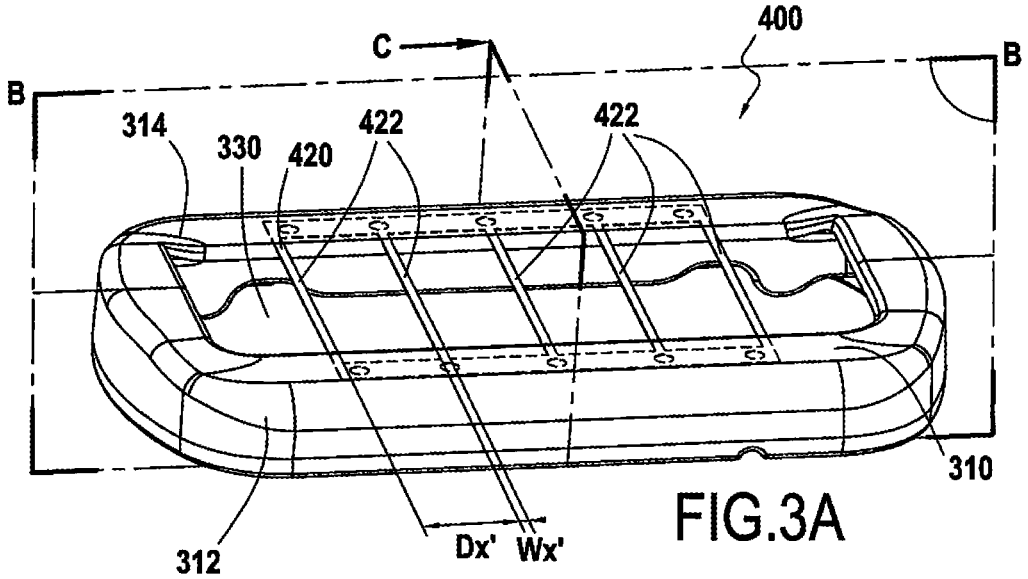
FIG. 3A details a perspective view of a skin adapter.
Figure 3B:
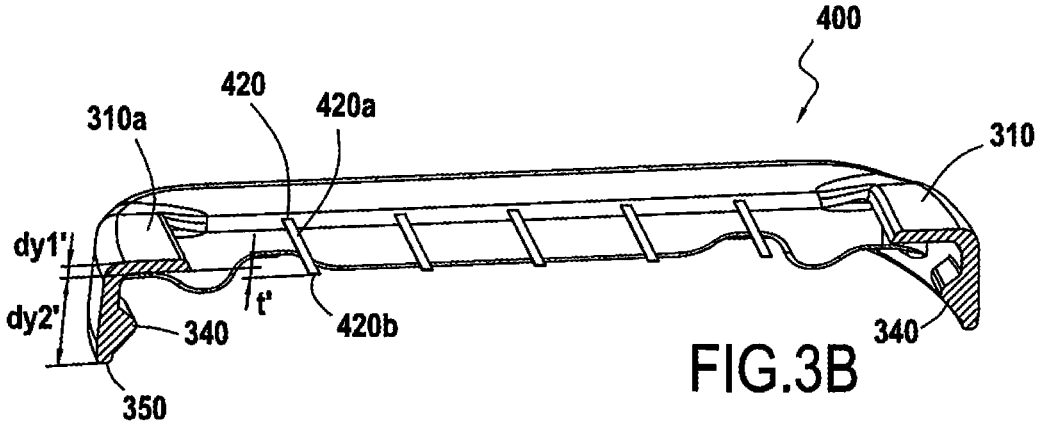
FIG. 3B details a perspective view of a cross-section of the skin adapter of FIG. 3A along plane B-B.
Figure 3C:
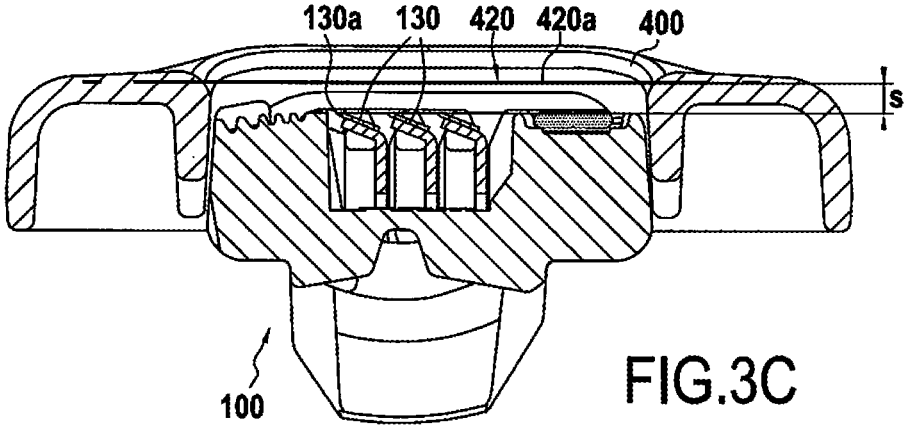
FIG. 3C details a perspective view of a cross-section of the skin adapter and razor along plane B-B.

FIGS. 3A-3C show a variation of the skin adapter 300 in FIGS. 2A-2C. The skin adapter of FIGS. 3A-3C may be formed by insert molding a foil 420 with the outer member 310. The foil 420 may comprise, for example, a metal, and the outer member 310 may comprise, for example, a polymer. A portion of the entire foil 420 may be encased during the insert molding process; however, it is envisioned that the entire foil may be encased during the insert molding process. In exception for the composition of materials and method of manufacture, the skin adapter 400 is similar to the skin adapter 300. Therefore, similar reference signs will be used and like description will be omitted.

Since the foil 420 is a separate component that could be used in insert molding process and due to the thickness of the foil, which may be, for example, 50 μm, the foil 420 assures that the closeness of the shaving operation may not be affected. The combination of the skin adaptor 400 along with the foil 420 results in that the glideness is enhanced and skin protection is significantly improved with the usage of the adaptor 400.

The foil 420 may comprise a plurality of ribbons 422. The plurality of ribbons 422 may extend between the leading and trailing portions 312, 314 of the outer member 310. The plurality of ribbons 422 may have a pitch or distance Dx' therebetween. The distance Dx' may be within a range of 2 to 20 mm, optionally 5 to 15 mm. Each of the ribbons 422 may have a width Wx' within a range of 0.3 to 3.5 mm, optionally 0.5 to 1.5 mm.

The ribbons 422 may be positioned within the aperture 330 of the outer member 310 but are dimensioned in a manner to allow a user to access the blades 130 of the head unit when the skin adapter 400 is attached to the head unit 100.

In this configuration, the skin adapter 400 acts as a guard between a user's skin and the blades 130 during a shaving operation. Similar to the skin adapter 300 in FIGS. 2A-2C, the effect of this configuration is to position the cutting edge 130*a* in a plane that is negative relative to the shaving plane. Incorporating a negative blade exposure on a head unit 100 reduces the occurrence of nicks and cuts.

Furthermore, the ribbons 422 may be adapted to comb or position the hair on the skin during a shaving operation. This configuration urges the hair into a more optimal position so that more hair may be cut during a single pass compared to a razor not incorporating the ribbons 320.

The foil 420 may include any appropriate number of ribbons 422 that would guard a user's skin from excessive contact with blades 130 while also permitting a user to access the blades 130 during a shaving operation, for example, 2 to 8 ribbons 422. In circumstances, an adapter comprising a single centered ribbon may be foreseen.

Shown in FIG. 3B is a cross-section of the shaving adapter 400 in FIG. 3A along plane B-B. The outermost surface 420*a*, or the surface facing away from the blades 130, of the ribbons 422 may be a distance dy1' from the outermost surface 310*a* of the outer member 310. dy1' may be defined as the vertical distance between the outermost surface 310*a* of the outer member and the outermost surface of the ribbon 420*a*. This distance may be a in a range of 1 mm<dy1'<3 mm for shaving and −10 mm<dy1'<1 mm for trimming.

The ribbons 422 may have a thickness t' within a range of 0.4 mm<t<1.0 mm for shaving and 1.0<t<10.0 mm for trimming. This thickness t' prevents the ribbons from deflecting toward the blades 130 of the head unit 100 when a user applies a pressure on the ribbons 422 during a shaving operation.

Additionally, the innermost surface 420*b* of the ribbons 422 may be a distance dy2' from a bottom surface 350 of the outer member 310. dy2' may be defined as the distance between the innermost surface of the ribbon 420*b* from the bottom surface 350 of the outer member. This distance may be a in a range of 3 mm<dy2<5 mm for shaving and 5 mm<dy2<15 mm for trimming.

Figure 4:
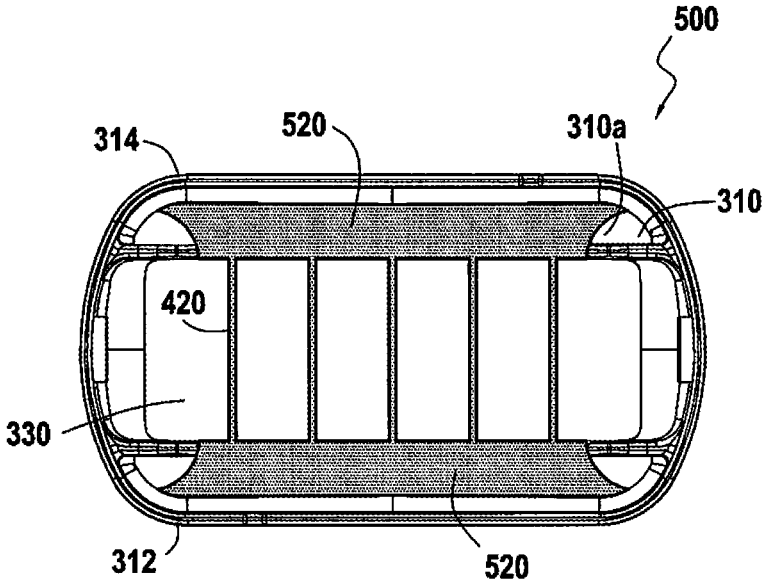
FIG. 4 details a perspective view a skin adapter.

FIG. 4 shows a variation of the skin adapter 400 shown in FIG. 3A. As such, like references will be used and like description will be omitted. The skin adapter 500 shown in FIG. 4 comprises lubricating elements 520 that are positioned on the outermost surface 310*a* at the leading and tailing portions 312, 314 of the outer member 310. These lubricating elements 520 may comprise a mixture of water soluble and water insoluble ingredients further combined with cosmetic ingredients for achieving skin benefits. The lubricating elements 520 may be configured to enhance the glideness of the skin adapter 500 and blades 130 (not shown) over the skin during a shaving operation.

Figure 5:
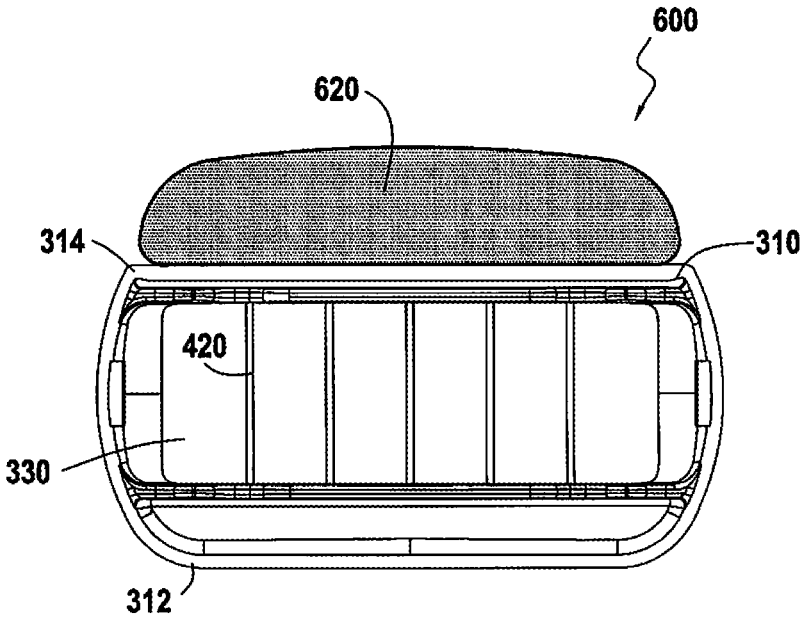
FIG. 5 details a variation of a skin adapter.

FIG. 5 shows a variation of the skin adapter 400 shown in FIG. 3A. As such, like references will be used and like description will be omitted. The skin adapter 500 shown in FIG. 5 comprises a shaving aid composition 620 that is positioned on the trailing portion 314 of the outer member 310. This shaving aid composition 620 may comprise soap. It is envisioned that the shaving aid composition 620 may be positioned on the leading portion 312 or at the leading and trailing portions 312, 314 of the outer member 310.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure. Additionally, any of the features of the described embodiments are combinable when not conflicting. For example, a skin adapter may include lubricating elements 520 and 620. Additionally, for example, lubricating elements 520 and/or 620 may be combinable with the skin adapter 300 shown in FIGS. 2A and 2B.

It is intended that the specification and examples be considered as exemplary only, with a true scope of the disclosure being indicated by a fair reading of the following claims.

The invention claimed is:

1. A skin adapter configured to attach to a head unit of a razor, the skin adapter comprising:

an outer member, the outer member having a leading portion with a leading side, a trailing portion with a trailing side, and an aperture arranged between the leading portion and the trailing portion, the leading portion and trailing portion being positioned on an outermost surface of the outer member, the aperture being inaccessible from the leading and trailing sides; and one or more ribbons positioned within the aperture of the outer member, the ribbons extending between the leading portion and trailing portion of the outer member.

2. The skin adapter according to claim 1, wherein the one or more ribbons have a width within a range of 0.3 mm to 3.5 mm.

3. The skin adapter according to claim 1, wherein the one or more ribbons comprises two or more ribbons arranged with a distance in between adjacent ribbons, wherein the distance between adjacent ribbons is within a range of 2 mm to 20 mm.

4. The skin adapter according to claim 1, wherein the one or more ribbons are at a distance from the outermost surface that is defined as the shortest distance between a plane positioned on and parallel to the outermost surface of the outer member and an outermost surface of the ribbon and that is in a range between 1 mm and 3 mm or between 10 mm and 1 mm.

5. The skin adapter according to claim 1, wherein the one or more ribbons are formed of a metal.

6. The skin adaptor according to claim 1, wherein the outer member further comprises a foil having the one or more ribbons.

7. The skin adaptor according to claim 6, wherein the foil is a separate component combined with the outer member through an insert molding process.

8. The skin adaptor according to claim 7, wherein the foil is encased in the outer member.

9. The skin adaptor according to claim 7, wherein the foil is 50 μm in thickness.

10. A razor comprising:

a handle;

a head unit comprising at least one shaving blade with a cutting edge, the head unit being configured to connect with the handle; and the skin adapter of claim 1.

11. The razor of claim 10, wherein the skin adapter is configured to expose at least a portion of the at least one razor blade.

12. The razor of claim 10, wherein a cutting edge plane is defined by a tangential line intersecting the cutting edge of each blade, and a distance "S" is defined as the shortest distance between the cutting edge plane and the outermost surface of the one or more ribbons.

13. A skin adapter configured to attach to a head unit of a razor, the skin adapter comprising:

an outer member, the outer member having a leading portion, trailing portion, and an aperture arranged between the leading portion and the trailing portion, and a foil comprising one or more ribbons positioned within the aperture of the outer member, the ribbons extending between the leading portion and trailing portion of the outer member, wherein the leading portion and trailing portion are positioned on an outermost surface of the outer member that faces away from the aperture.

14. The skin adapter according to claim 13, wherein the one or more ribbons have a width within a range of 0.3 mm to 3.5 mm.

15. The skin adapter according to claim 13, wherein the one or more ribbons are at a distance from the outermost surface that is defined as the shortest distance between a plane positioned on and parallel to the outermost surface of the outer member and an outermost surface of the ribbon and that is in a range between 1 mm and 3 mm.

16. The skin adaptor according to claim 13, wherein the leading portion comprises a leading side and the trailing portion contains a trailing side, and wherein the aperture is inaccessible from the leading and trailing sides.

17. The skin adaptor according to claim 16, wherein the foil is a separate component combined with the outer member through an insert molding process.

18. The skin adaptor according to claim 17, wherein the foil is encased in the outer member.

19. The skin adaptor according to claim 18, wherein the foil is 50 μm in thickness.

20. A razor comprising:

a handle;

a head unit comprising at least one shaving blade with a cutting edge, the head unit being configured to connect with the handle; and the skin adapter of claim 13.

* * * * *